US007090908B1

(12) United States Patent
McKay

(10) Patent No.: US 7,090,908 B1
(45) Date of Patent: Aug. 15, 2006

(54) LINT TAPE ROLL WITH PEELING FEATURE

(75) Inventor: William D. McKay, Grand Blanc, MI (US)

(73) Assignee: The Hartz Mountain Corporation, Secaucus, NJ (US)

( * ) Notice: Subject to any disclaimer, the term of this patent is extended or adjusted under 35 U.S.C. 154(b) by 89 days.

(21) Appl. No.: 10/781,486

(22) Filed: Feb. 18, 2004

(51) Int. Cl.
*A47L 25/00* (2006.01)
*B65D 65/28* (2006.01)

(52) U.S. Cl. ..... 428/43; 428/40.1; 15/104; 15/2

(58) Field of Classification Search ..... 15/104.001, 15/104.002, 104.011; 428/40.1, 43
See application file for complete search history.

(56) References Cited

U.S. PATENT DOCUMENTS

| | | | | |
|---|---|---|---|---|
| 2,271,189 | A | 1/1942 | Garthwait | |
| 2,506,333 | A | 5/1950 | Bedynek | |
| 2,612,336 | A | 9/1952 | Tuttle | |
| 3,011,499 | A | 12/1961 | Tajan | 401/139 |
| 3,056,154 | A | 10/1962 | Neal | 15/104 |
| 3,102,544 | A | 9/1963 | Keegan et al. | 132/147 |
| 3,158,887 | A | 12/1964 | Kanbar et al. | 15/104 |
| 3,299,461 | A | 1/1967 | Marks | 15/104 |
| 3,373,457 | A | 3/1968 | Rouch, Jr. | 15/104 |
| D216,942 | S | 3/1970 | Safalow | |
| 3,665,543 | A | 5/1972 | Nappi | 15/215 |
| 3,742,547 | A | 7/1973 | Sohmer | 15/104 |
| D238,127 | S | 12/1975 | Snyder | |
| 4,062,083 | A | 12/1977 | McKay | 15/106 |
| 4,107,811 | A | 8/1978 | Imsande | 15/215 |
| 4,244,587 | A | 1/1981 | Schweizer | 15/104.8 |
| 4,361,923 | A | 12/1982 | McKay | 15/104 |
| 4,399,579 | A | 8/1983 | McKay | 15/104 |
| 4,422,201 | A | 12/1983 | McKay | 15/104 |
| 4,489,912 | A | 12/1984 | Haythornthwaite | |
| 4,519,566 | A | 5/1985 | Manzi | |
| 4,727,616 | A | 3/1988 | Kucera et al. | 15/104 |
| 4,850,073 | A | 7/1989 | Preuss | 15/207.2 |
| 4,905,337 | A | 3/1990 | McKay | 15/104 |
| D311,995 | S | 11/1990 | Garcia | |
| D314,282 | S | 2/1991 | Gingras | |
| 5,027,465 | A | 7/1991 | McKay | 15/104 |
| D320,680 | S | 10/1991 | Stetson et al. | D30/158 |
| D342,610 | S | 12/1993 | Stetson et al. | D4/122 |
| D363,214 | S | 10/1995 | Parola et al. | D9/300 |
| 5,819,989 | A | 10/1998 | Saraceni | 221/192 |
| 5,878,457 | A | 3/1999 | Cox et al. | 15/104.002 |
| 5,940,921 | A | 8/1999 | Wood et al. | |

(Continued)

*Primary Examiner*—Harold Pyon
*Assistant Examiner*—Patricia L. Nordmeyer
(74) *Attorney, Agent, or Firm*—Gottlieb, Rackman & Reisman, P.C.

(57) ABSTRACT

A tape roll formed of a plurality of individually separable sheets of outwardly faced adhesive tape has a separation element carried on the substrate to separate at least one of the longitudinally extending, lateral side edges or one of a separable lateral edge to from the remainder of the tape roll. The separation element may take the form of embossings, punchings or a resilient layer to separate the edges of the tape roll from each other and to provide an easily grasped edge for separation of the outermost sheet from the roll.

12 Claims, 7 Drawing Sheets

U.S. PATENT DOCUMENTS

| | | | | |
|---|---|---|---|---|
| D419,306 | S | 1/2000 | Hansen et al. | |
| 6,014,788 | A | 1/2000 | Jaffri | 15/104.002 |
| 6,055,695 | A | 5/2000 | McKay, Jr. | 15/104.002 |
| 6,127,014 | A | 10/2000 | McKay, Jr. | 428/43 |
| D441,538 | S | 5/2001 | Petner | |
| D446,023 | S | 8/2001 | Sherman | |
| 6,298,517 | B1 | 10/2001 | McKay | 15/228 |
| 6,321,408 | B1 | 11/2001 | Esterson et al. | |
| 6,325,070 | B1 | 12/2001 | Tyroler et al. | 132/112 |
| 6,449,794 | B1 | 9/2002 | Jaffri | |
| 6,756,102 | B1 | 6/2004 | Galo | |
| 2002/0144367 | A1 | 10/2002 | McKay, Jr. | |
| 2003/0096074 | A1 | 5/2003 | Kim | |
| 2004/0154133 | A1 | 8/2004 | Polzin et al. | |
| 2004/0194240 | A1 | 10/2004 | McKay, Jr. | |

LINT TAPE ROLL WITH PEELING FEATURE

BACKGROUND

This invention relates generally to tools for picking up particles from surfaces, such as clothing, pets, floors, carpets, furniture, and more specifically, to an adhesive tape lint remover having removable cleaning sheets.

Surfaces such as floors, clothing, pets, and furniture are most aesthetically pleasing and safe when they are clean, free from unsightly particles. Unfortunately these surfaces typically become soiled with particles from the environment, such as pets shedding hair, settling dust particles, dandruff from dry scalps and pets. Numerous devices and methods have been developed for returning a surface to a clean, particle free condition and people are constantly striving to develop better methods. Sweeping, brushing, vacuuming or using adhesive tape lint removers work well. However, most suffer from the drawback of being time consuming and difficult to use. For example, a small piece of lint, dandruff or hair may be located on an article of clothing or floor. Using a vacuum requires a person to locate the vacuum cleaner, uncoil and plug in a power cord, select the correct attachments, vacuum up the hair or lint and reverse the process to put the vacuum cleaner away.

Likewise using a brush simply moves particles from one surface to another and requires either picking the hair or lint up from another surface or cleaning the brush. Alternatively a person may use an adhesive tape lint remover. This is also undesirable for many people since it is difficult to grasp individual layers and remove one at a time. Some persons may find locating and grasping individual sheets difficult and uncomfortable as they have physical limitations. Other people may find the dry edges unacceptable as they reduce the quantity of adhesive surface area for cleaning. Therefore, there is a need for improved devices and methods for simple cleaning duties such as removing lint, pet hair, and dandruff from clothing or floors.

Previous attempts to address this need include lint removal brushes with directional fabric, adhesive tape lint removers with non-adhesive edges, electrostatic charged dusting cloths, and small hand held vacuum cleaners. However these solutions do not adequately address the needs of typical homeowners.

Prior adhesive tape lint removers include a roll of adhesive faced sheets which are individually separable from the roll when dirty thereby exposing a fresh, clean sheet for further cleaning.

Since the adhesive faced sheets within the interior of the roll adhesively contact the next outermost sheet, it is frequently difficult to find an edge of the outermost sheet to peel the outermost sheet from the roll. As a result, non-adhesive or dry areas, typically in the form of a strip extending longitudinally along one or both sides of the tape roll, are employed to provide a non-adhesive edge which can be more easily grasped by a user to peel the outermost sheet from the roll.

The present Applicant has also devised a pull tab on the end of each sheet which carries a non-adhesive area to facilitate separation of the outermost sheet from the remainder of the roll.

However, despite the use of non-adhesive areas, there is a tendency for the adhesive faced roll to compress due to the pressure applied on the roll during a cleaning operation when the roll is moved across a surface or simply through aging of the adhesive. This causes the individual windings of the roll to be more strongly adhesively jointed together and resist easy separation, despite the presence of dry, non-adhesive areas.

Thus, it would be desirable to provide a lint tape roll which has peelable features to facilitate easier removal of the outermost sheet from the roll. It would also be desirable to provide a lint tape roll in which peelable features are incorporated into the roll without significant modification to existing roll materials and manufacturing processes.

SUMMARY

The present invention is a lint tape roll which includes a unique means for separating the lateral side edges or the lateral sheet edge of the tape roll from the roll to facilitate grasping of the outermost sheet to peel the outermost sheet from the roll.

In one aspect, the tape roll includes a substrate having opposed side edges and first and second major opposed surfaces. An adhesive layer is carried on one major surface of the substrate. The substrate is wound into a roll with the adhesive layer facing outwardly from the roll. A separable edge extends laterally at least partially through the roll dividing the roll into a plurality of individually separable sheets. Means are applied to at least one side or lateral edge of the substrate for separating the edge from an adjacent wound edge of the substrate to facilitate removal of an outermost sheet from the roll.

In one aspect, the separating means are deformations formed in the substrate along at least one of the side edges and the lateral edge. The deformations may be embossings permanently deforming the substrate. The embossing can extend longitudinally along at least one side or lateral edge of the substrate or angularly with respect to at least one side or lateral edge of the substrate. The embossings may extend from the outer surface or the inner surface of both of each winding of the roll.

In another aspect, the deformations are punchings formed in the substrate and creating a partial aperture in the substrate. A separated portion of the substrate in each punching extends away from one major surface of the substrate into contact with an underlying winding of the substrate. In another aspect, the separating means is a resilient element carried on at least one of the side edges or lateral edge of the substrate. The resilient element can be in the form of a longitudinally extending strip carried on the outer surface, the inner surface, or both of the rolled substrates. In another aspect, a non-adhesive portion is formed along at least one of the side edges or the lateral edges of the substrate. The separating means can be carried on the non-adhesive portion. In another aspect, the separating means is fixed to the adhesive layer on the substrate.

In yet another aspect, the tape roll includes a plurality of pull tabs formed by non-adhesive portions between the side edges of the tape roll and on one surface of the tape. Each non-adhesive portion is disposed in registry with one separable edge of the tape roll to define one pull tab on each sheet to facilitate removal on the outermost sheet from the roll. In this aspect, the separating means is carried on each of the pull tabs.

The unique separating means of the present invention enlarges the diameter of the roll and at least one of the side or lateral edges separates the edges of a wound lint tape roll from each other to provide an easy grippable edge to facilitate removal of the outermost sheet from the roll. The separating means may be formed in a number of different configurations and structures, all of which can be easily incorporated into a tape roll without significant modification to the existing tape roll construction.

BRIEF DESCRIPTION OF THE DRAWING

The various features, advantages and other uses of the present invention will become more apparent by referring to the following detailed description and drawing in which.

DETAILED DESCRIPTION

Figure 2:
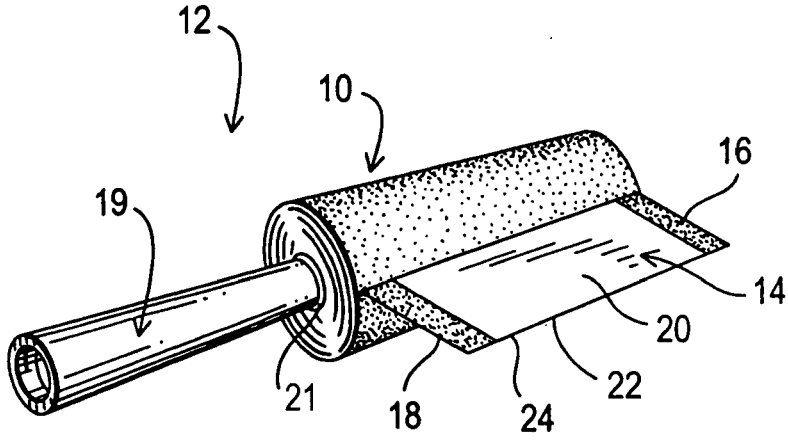
FIG. 2 is a perspective view of the lint removal apparatus of FIG. 1 shown at the beginning of the removal of the outermost sheet from the roll.
Figure 1:
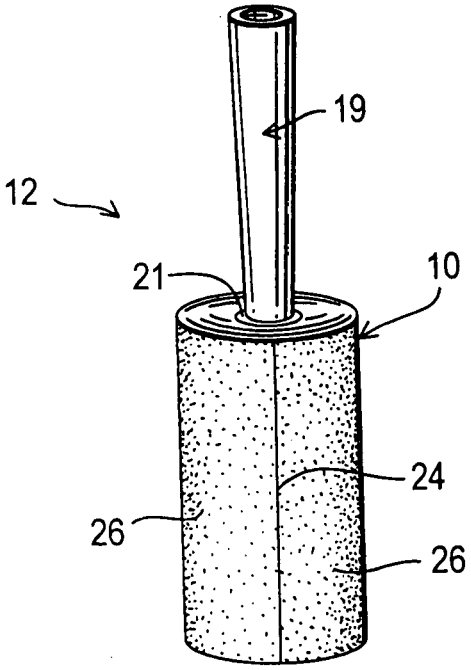
FIG. 1 is a perspective view of a lint removal apparatus according to one aspect of the present invention.

Referring now to FIGS. 1 and 2, there is depicted a tape roll 10 for a lint removal apparatus 12 according to the present invention. A tape strip or substrate 14 wound into the roll 10 is preferably formed of at least two material layers, one constituting a substrate or backing layer and the other constituting an adhesive layer, both forming opposed side edges 16 and 18 and opposed, major, first and second surfaces 20 and 22 on the substrate 14.

The substrate 14 is formed of a suitable material, such as silicone coated flat backed paper or crepe paper or plastic film. Any, suitable paper and plastic films, known in the relevant industry, may be employed. The substrate 14 can be opaque, transparent, colored or have printed indicia thereon as well as being formed with different surface textures or embossments.

The adhesive layer is disposed on or applied to substantially all or one major surface 20 or 22 of the substrate 14. According to the present invention, the adhesive layer is applied to the substantially all of one major surface 20 or 22 of the substrate 14 between the side edges 16 and 18.

Suitable adhesives which form a tacky, partially pressure sensitive surface for picking up lint and debris from other surfaces as generally known in the relevant industry may be employed. Typically, such adhesives are known as "pressure sensitive" adhesives and are normally tacky at room temperature. Such adhesives can be adhered to a surface by the application of light pressure.

Further details concerning the types of materials which can used to form the substrate 14 and the adhesive layer may be found by referring to U.S. Pat. No. 5,027,465, the relevant portions of which pertaining to the substrate and adhesive materials are incorporated herein by reference.

As shown in FIGS. 1–5, the tape 10 is wound into a continuous roll about a core or in a coreless fashion. An interior bore 20 is formed in the roll 10 for the core, if used, and/or for receiving a rotatable handle element.

A separable edge 24 is formed substantially through the roll 10 at one location between the side edges 16 and 18. The edge 24 maybe formed by perforations, slits or combinations thereof. The separable edge 24 divides the tape 10 into a series of end to end arranged sheets 26. As described hereafter, the outermost sheet 26 may be removed from the roll 10 after it is soiled thereby to enable a new clean sheet 26 to replace the soiled and removed outer sheet on the exterior surface of the roll 10.

Figure 3:
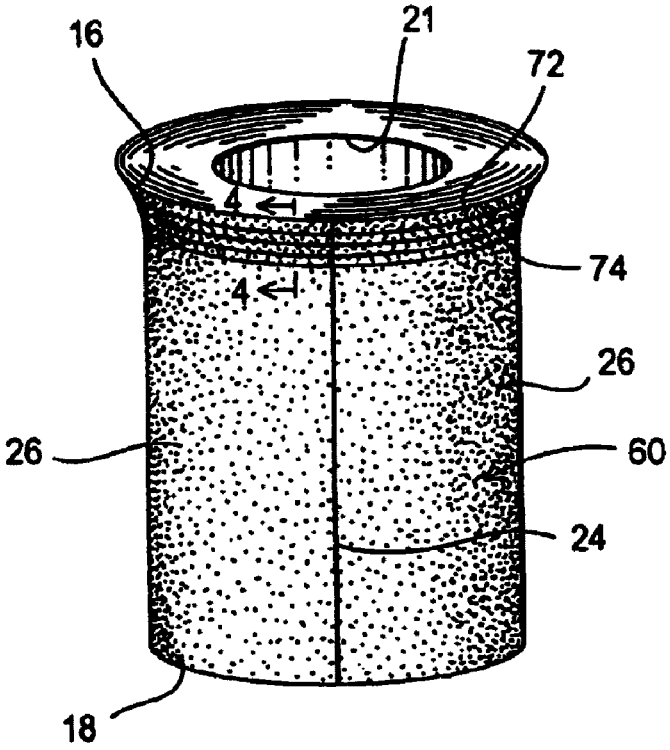
FIG. 3 is a perspective view of a lint roll with one aspect of a peelable feature according to the present invention.
Figure 4:
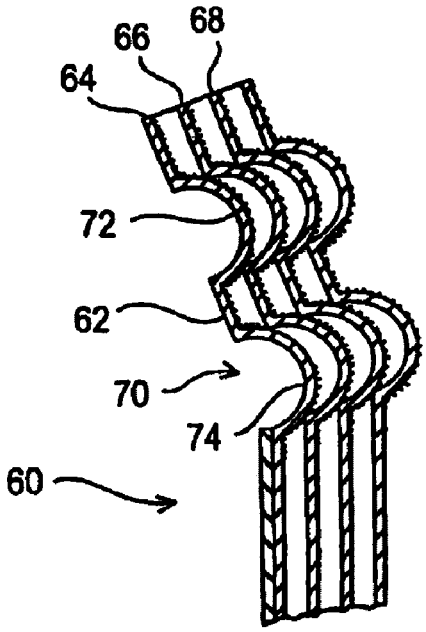
FIG. 4 is a cross-sectional view generally taken along the line 4—4 in FIG. 3.

Referring now to FIGS. 3 and 4, there is depicted a tape roll 60 constructed in the manner described above with at least one non-adhesive or dry edge denoted by reference number 62. Means 70 are provided for spacing the edges 64, 66 and 68 of the roll 60, with three edges being shown only by way of example, of each sheet or winding from the adjacent underlying or overlying sheet edges to facilitate separation of the outermost sheet from the roll 60. It will be understood that although the separating means 70 will be described as being formed in or carried on at least one dry edge 62 of the roll 60, the separating means 70 could also be formed in the roll 60 which does not have any dry or non-adhesive longitudinally extending edges. In this configuration, the separating means 70 is formed directly in or on the adhesive surface of the substrate 14.

The separating means 70 in the aspect of the invention shown in FIGS. 3 and 4 is in the form of one or more embossings, with two embossings 72 and 74 being depicted by way of example only. The embossing 72 and 74 are in the form of depressions permanently forming a portion of the substrate 14 out of the plane of one major surface of the substrate 14. The embossing 80 may be formed on the inward facing or the outward facing side of the substrate 14. The embossings 72 and 74 have a channel-like, recess shaped configuration shown in FIG. 4, by example only. The longitudinal extent of each embossing 72 and 74 may be in the form of a straight sided channel. However, irregularly shaped recesses or depressions will minimize any nesting of the embossings 72 and 74 between windings when the roll 60 is wound. However, even if the deformations are shaped identically, the change in diameter as the roll grows during winding may prevent nesting. The embossings 72 and 74 can be continuous along the length of the roll 60 or can be in the form of discontinuous segments along the length of the roll 60.

The embossings 72 and 74 separate the outer edges 64, 66 and 68, for example, of the sheets forming the roll 60 from each other thereby enabling easy grasping of the edge 64 of the outermost sheet 24 of the roll 60 to separate or peel the outermost sheet from the roll 60 when it is desired to remove the outermost sheet from the roll 60.

Figure 5:
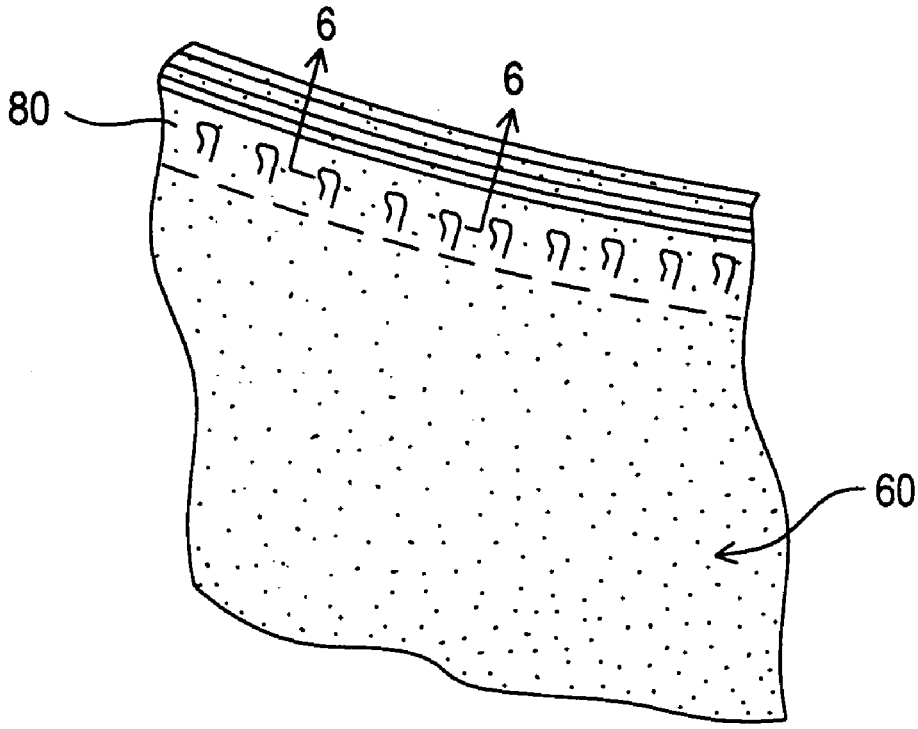
FIG. 5 is a partial, enlarged perspective view of a lint tape roll with a peelable feature according to another aspect of the present invention.
Figure 6:
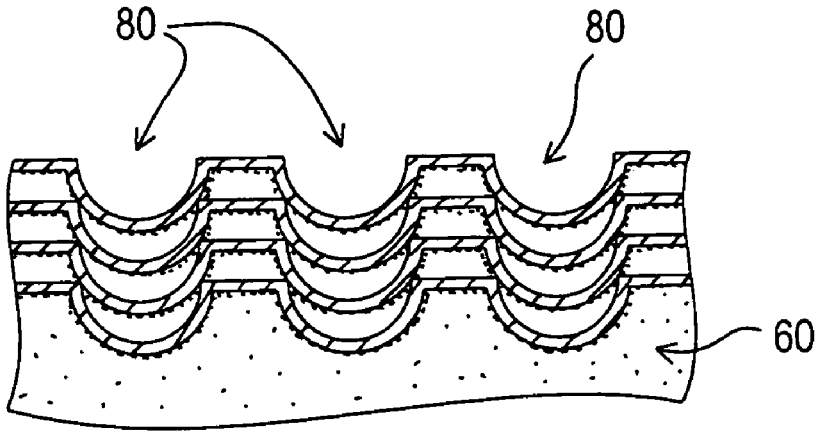
FIG. 6 is a cross-sectional view generally taken along the line 6—6 in FIG. 5.

In another aspect of the present invention shown in FIGS. 5 and 6, embossings 80 can also be formed in one or more of the lateral side, non-adhesive or dry areas of the roll 60, but in a transverse or lateral direction with respect to the longitudinal axis of the roll 60. The embossings 80 are also in the form of channel-like depressions formed into the substrate 14 which deform a portion of the substrate 14 out of the plane of the major surfaces of the substrate 14.

The embossings 80 may have any channel-like configuration, such as channels with relatively straight sidewalls, or irregular shaped sidewalls as shown in FIG. 5. The embossings 70 and 80 may also take a number of different shapes, as shown in FIGS. 9A through 9F and described hereafter.

Figure 7:
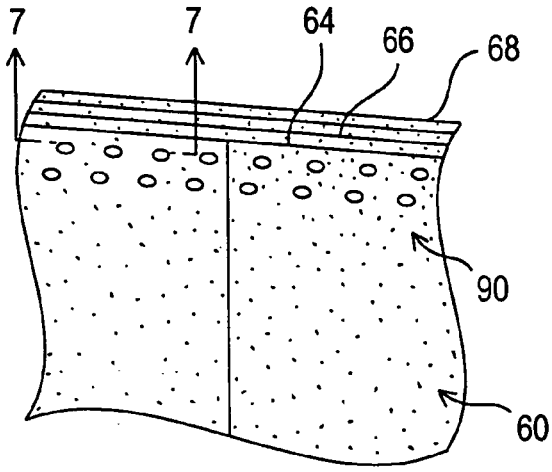
FIG. 7 is a partial, enlarged perspective view of a lint tape roll with a peelable feature according to another aspect of the present invention.
Figure 8:
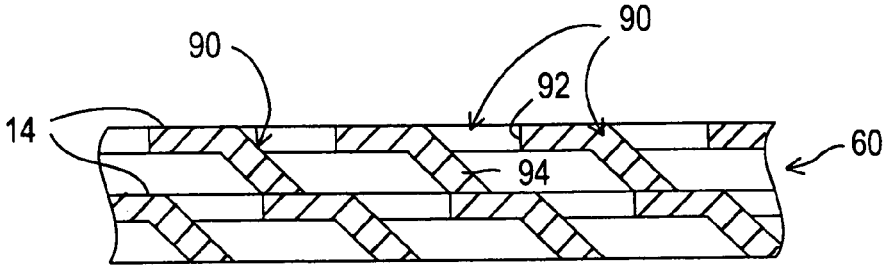
FIG. 8 is a cross-sectional view generally taken along line 8—8 in FIG. 7.
Figure 9A:
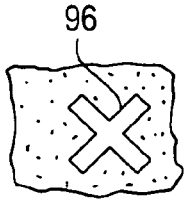
FIGS. 9A, 9B, 9C, 9D, 9E, and 9F are plan views of alternate deformation configurations useable in the peelable feature aspect shown in FIGS. 7 and 8.
Figure 9B:
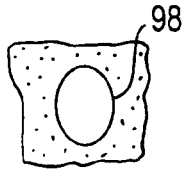
Figure 9C:
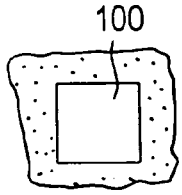
Figure 9D:
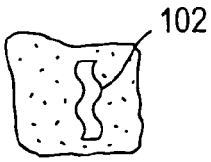
Figure 9E:
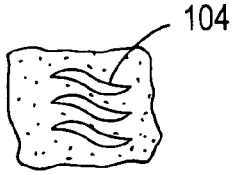
Figure 9F:
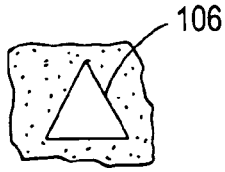

The embossings 70 and 80 described above are formed as recesses in the substrate 14 in which the innermost deformed portion of each recess 70 or 80 is closed and defines a continuous part of the substrate 14. In another aspect of the separation means of the present invention, as shown in FIGS. 7 and 8, a plurality of punchings 90 are formed along at least one or both lateral edges of the tape roll 60. The punchings 90 form an aperture 92 in the substrate 14. However, the separated portion 94 of each punching 90 extends less than 360° which forms the separated portion 94 as a flap extending radially inward into contact with the underlying sheet of the roll 60. While the separated portions 94 will be compressed to a small extend toward the aperture 92 during winding of the roll 60, the presence of the separated portions 94 between each winding or sheet of the roll 60 will increase the thickness of the roll 60 along at least one or both of the lateral edges thereby separating the outermost edge 64 from the next adjacent underlying edge 66. This forms an opening which enables the outermost sheet to be easily grasped and peeled from the roll 60.

Although the punchings 90 are shown in FIG. 7 as having a circular configuration, other configurations are also possible. As shown in FIGS. 9A–9F the punchings 90 may have a cross or X-shape 96, an oval shape 98, a square or rectangular shape 100, an irregularly formed shape 102, a plurality of individual recesses 104, or a triangular shape.

The deformations 80 or 90 may be disposed completely on the non-adhesive longitudinal edge, partially on the non-adhesive edge or completely inboard of the longitudinal edge.

If the deformations 80 or 90 are formed on the backside of the substrate 14, in the case of the pop-up or intermittent non-adhesive spot, the deformations 80 or 90 can be placed on top of a double layer of release coat. The first coat provides just enough release for the tape to stay wound. The second coat provides greater release than the first coat, thus creating the pop-up tab.

Figure 10:
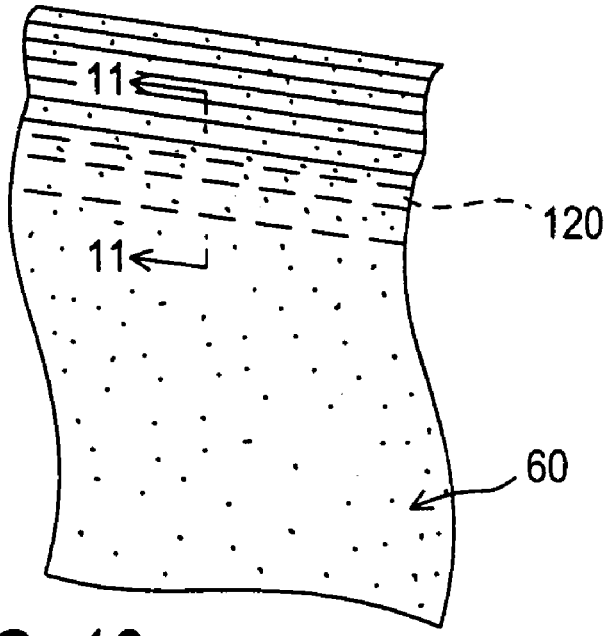
FIG. 10 is a partial, enlarged perspective view of a lint tape roll having a peelable feature according to another aspect of the present invention.
Figure 11:
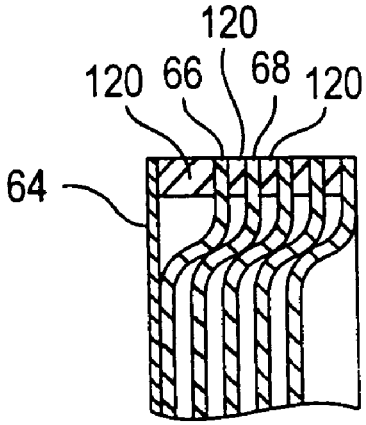
FIG. 11 is a cross-sectional view generally taken along the line 11—11 in FIG. 10.

Referring now to FIGS. 10 and 11, another aspect of the separating means of the present invention is depicted. In this aspect, the separating means is in the form of a strip of resilient or expanded material 120 which is interposed along the laterally outside edges 64, 66 and 68, etc., of each sheet or winding of the roll 60. The strips 120 may be carried on one or both of the lateral edges of the roll 60.

The strips 120 may be formed of a resilient material, such as a hot melt wax or a resilient water foamable, pre-polymer resin and reaction mixture which is allowed to form and cure to form a self cross-linked, open celled, resilient polyurethane foam body, which is applied to the adhesive surface along the edges 64, 66 and 68, for example only, of the roll 60. Alternately, the strip 120 may be applied over a dry portion formed on the lateral edges 64, 66 and 68 of the roll 60.

The resilient material is applied during or after the adhesive coating process or in the converting machine where the tape rolls are wound into the final useable sizes.

The resilient material may be applied to the adhesive surface of each sheet of the roll 60 in an unexpanded form, with subsequent expansion caused by chemical reaction, heat application, etc., which causes the foam material to expand to an enlarged state as shown in FIG. 11. This separates the edges 64, 66 and 68 of each sheet of the roll 60 from each other while providing an easy means for grasping the edge of the outermost sheet to separate the outermost sheet from the roll 60.

Figure 12:
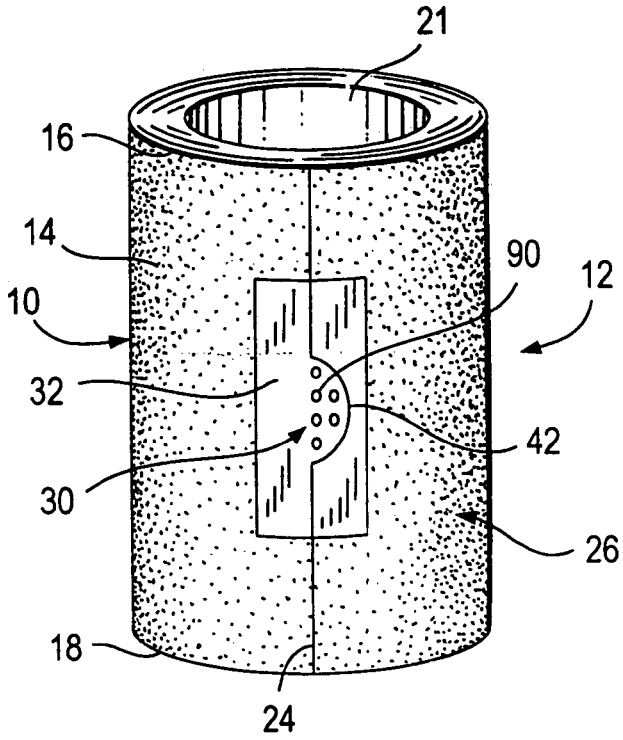
FIGS. 12 and 13 are perspective views of a lint tape roll having a peel tab having a pull tab with a peelable feature according to the present invention.
Figure 13:
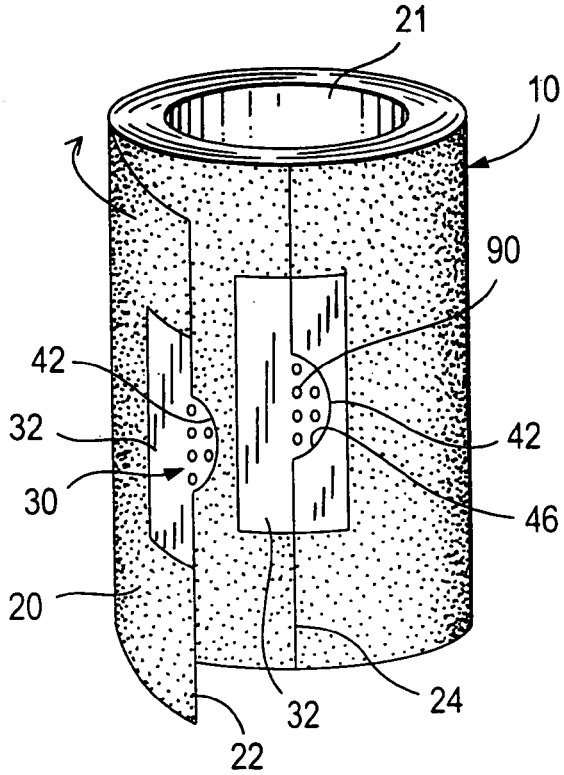

Referring to FIGS. 12 and 13, the separating means of the present invention may also be applied to a lint roll 12 having pull tabs 30 formed along the separable edge of each sheet 24. Further details concerning the construction and use of the pull tabs 30 can be had by referring to Applicant's pending application Ser. Nos. 10/080,089 and 10/120,720, the contents of which pertaining to the use, structure and function of the pull tabs is incorporated herein in its entirety.

Figure 14A:
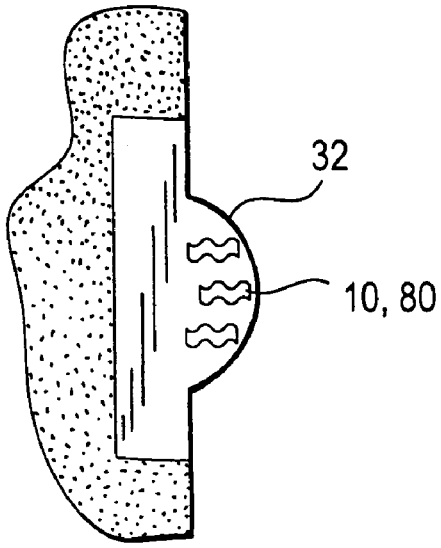
FIGS. 14A and 14B are partial, plan views of the pull tab shown in FIG. 13, but depicted with peelable features according to other aspects of the present invention.

A pull tab denoted in general by reference number 30 is provided in registry with the separable edge 24 of each sheet 26. One portion of the pull tab 30 extends across the edge 24 so it can be easily separated from the surrounding adhesive on the underlying sheet 26 to allow the edge 24 of the outer most sheet 26 to be pulled away from the roll 10 as shown in FIG. 14, unwound and removed from the roll 10.

The pull tab 30, which may have many different shapes, can be part of a substantially non-adhesive area 32 which is formed by various means, also described hereafter, on the adhesive layer of each sheet 26. Preferably, the non-adhesive area 32 is disposed in registry with the separable edge 24 of each sheet 26 from the roll 10. The term "registry" will be understood to encompass configurations where the area 32 of the pull tab 30 overlays and spans the separable edge 24 or is disposed in substantial contact or spaced a small distance up to ½ inch from the edge 24 with a portion of the edge 24 such that the entire area 32 extends away from the edge 24 and does not span the edge 24. The non-adhesive area 32 can take different configurations, such as a polygonal configuration, where the area 32 has a square, rectangular or other polygonal shape, or a circular configuration. The non-adhesive areas 32 can also be provided in a color different than the color of the tape or printed with indicia, such as "pull here".

The pull tab 30 can be formed in a number of different ways, each defining a tab adjoining a part of the sheet 26 on the roll 10 but which has a non-adhesive radially outermost surface to allow the pull tab 30 on the outermost sheet 26 to be easily grasped and pulled to facilitate removal of the outer sheet 26 from the roll 10.

For example, the non-adhesive area 32 can be formed of a thin material layer or sheet, including, but not limited to, plastic films, non-woven fabrics, papers, Tyvek, which has at least one substantially non-adhesive surface. Alternately, the non-adhesive area 32 can be formed of a coating, such as a UV cured or fast drying material, such as silicone or varnish, or a transferable ink including a stamped or jet sprayed ink or a hot melt wax. According to the present invention, "non-adhesive" area means an area or surface which has or is formed of a partial or complete non-adhesive surface or coating. For example, silicone or varnish can be screened onto the adhesive layer so as to cover a portion of the adhesive layer, i.e. 90%, for example, and thereby provide a slightly tacky surface which can assist in pulling the next pull tab away from the tape roll 12.

Further, the non-adhesive area 32 is formed on the roll 10 in the location of each separable edge 24 between adjacent wound sheets 26 so that the pull tabs 30 and non-adhesive areas 32 overlay each other. The non-adhesive areas 32 are longitudinally spaced along the length of the tape 12. the spacing between consecutive non-adhesive areas 23 can be equal or non-equal. The non-adhesive areas 32, while depicted as being centered between the side edges 16 and 18 of the tape 12, can be formed at any other position between the side edges 16 and 18.

Alternately, the pull tab 30 can be defined as a non-adhesive portion of the substrate of the tape 12 wherein the area 32 is masked or blocked off from the application of adhesive to the substrate during the coating of the substrate of tape 12.

As described above, the pull tab 30 may be formed on different combinations of area configurations, such as areas 32, 34 and 36 as well as different edge shapes as described hereafter.

The separable edge 24 between adjacent sheets 26 on the roll 10 extends completely through the roll 10. The pull tab 40 which overlays the non-adhesive area 34 enables a user to insert his or her finger or fingernail beneath the edge 24 and raise the end of the tab 40 away from the roll 12.

The separable edge 24 may also be discontinuous between two continuous severed or slit portions extending at least partially through the entire roll 10. The discontinuity defines a bridge which assists in maintaining the integrity of the slit or cut in the tape roll 10. It is known that some roll tapes have memory which is defined as the tendency of the tape to return to its original elongated shape prior to winding into a roll. This shape memory can make the tape roll open up at the slit or "butterfly." The bridge assists in maintaining the roll 24 in its desired wound shape since the discontinuity or bridge 42 remains connected to the underlying clean sheet 26 until the outer soiled sheet is completely unwrapped from the roll 10. Just before the outer sheet 26 completely separates from the roll 10, the bridge then rips away and actually lifts the pull tab 30 radially outward thereby providing easy access to the next sheet 26 to be removed when soiled.

Figure 14B:
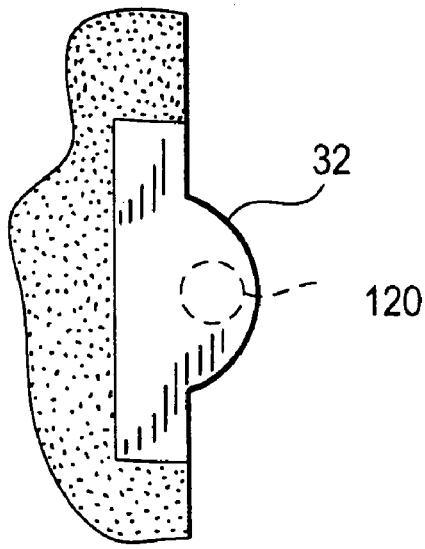

Any of the separating means 70, 80, 90, or 120, previously described may be employed on the pull tab 30. Thus, the punchings 90 may be provided on the pull tab 30 as shown in FIGS. 13 and 14. Alternately, the laterally or longitudinally extending recesses 70 or 80 may be applied to the pull tab 32 as shown in 14A. Further, the use of a resilient tab or foamed area 120 may also be provided on the pull tab 32 as shown in FIG. 14B.

Further, the separating means may be used with a pull tab which does not include a non-adhesive area.

In summary, there has been disclosed a tape lint roll with an adhesive face which has unique peelable features which enhance the easy separation of the outermost sheet from the roll. Separating means in the form of embossments, longitudinal punchings, and/or resilient layers are formed or applied to the side or lateral edges of the roll to enlarge the roll at the edges to separate the edges from each other. This facilitates the ability of a user to grasp the edge of the outermost sheet to remove the sheet from the roll.

The separating means of the present invention are formed in a number of different configurations and shapes on existing tape rolls without requiring modification to the basic construction of the tape roll. The unique separating means may also be applied to a pull tab formed on the end of each separable sheet.

What is claimed is:

1. A tape roll for a lint removal roller assembly comprising:

a substrate having opposed side edges and first and second major opposed surfaces of the tape;

an adhesive layer carried on the first major surface of the substrate;

the substrate wound into a roll with the adhesive layer facing outwardly from the roll;

a separable leading edge extending laterally between said side edges at least partially through the roll for dividing the roll into a plurality of individually separable sheets; and deformations formed in each sheet of the substrate adjacent at least a portion of one of the side edges or the leading separable edge for spacing at least said portion of one of the side edges and the leading separable edge of an outer sheet of the roll away from corresponding portions of an abutting underlying sheet of the roll in order to facilitate separation of said outer sheet.

2. The tape roll of claim 1 wherein the deformations comprise:

embossings permanently deforming the substrate.

3. The tape roll of claim 2 wherein:

the embossings extend one of longitudinally continuously and discontinuously along at least one of the side edges and the leading separable edge of the substrate.

4. The tape roll of claim 3 wherein:

the embossings extend laterally with respect to at least one of the side edges and the leading separable edge of the substrate.

5. The tape roll of claim 1 wherein the deformations comprise:

at least one punching formed in the substrate and creating a partial aperture in the substrate, with a separated portion of the substrate created by the punching extending away from one major surface of the substrate into contact with an adjacent portion of the substrate.

6. The tape roll of claim 1 wherein:

the deformations are carried on at least one of an inner surface and an outer surface of the tape roll.

7. The tape roll of claim 2, wherein the embossings are formed on either of the first or second major opposed surfaces.

8. The tape roll of claim 2 wherein said embossings have a recessed shape configuration defining a channel.

9. The tape roll of claim 8, wherein said channel has irregular shaped sidewalls.

10. The tape roll of claim 5 wherein the separated portion of the substrate defines a flap extending partially inward into contact with an underlying sheet of the roll.

11. The tape roll of claim 5, wherein said at least one punching has a configuration selected from the group consisting of circular, x-shape, oval, square and rectangular.

12. A tape roll for a lint removal device comprising:

an extending substrate with opposed tape surfaces;

an adhesive layer carried on at least a portion of one of said surfaces;

the substrate being wound into a roll with the adhesive layer facing outwardly from the roll;

the roll being divided into a plurality of individually separable sheets with each sheet having a leading edge and opposed side edges; and deformation formed in each sheet and extending longitudinally adjacent at least a portion of one of said side edges and said leading edge of each said sheet.

* * * * *